US007360434B1

(12) United States Patent
Hayes et al.

(10) Patent No.: US 7,360,434 B1
(45) Date of Patent: Apr. 22, 2008

(54) APPARATUS AND METHOD TO MEASURE AIR PRESSURE WITHIN A TURBINE AIRFOIL

(75) Inventors: Douglas A. Hayes, Port St. Lucie, FL (US); John E. Ryznic, Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 0 days.

(21) Appl. No.: 11/648,124

(22) Filed: Dec. 30, 2006

Related U.S. Application Data

(60) Provisional application No. 60/755,598, filed on Dec. 31, 2005.

(51) Int. Cl.
*F01D 5/18* (2006.01)

(52) U.S. Cl. ..... 73/756; 73/23.22; 73/23.27; 416/97

(58) Field of Classification Search ..... 73/756, 73/23.24, 23.27; 416/97
See application file for complete search history.

(56) References Cited

U.S. PATENT DOCUMENTS 4,088,155 A 5/1978 Echtler
4,130,017 A 12/1978 Benedict et al.
5,602,340 A 2/1997 Lemaire et al.
6,273,682 B1 * 8/2001 Lee ..... 416/97 R
6,471,479 B2 * 10/2002 Starkweather ..... 416/97 R
6,491,496 B2 * 12/2002 Starkweather ..... 416/97 R
6,843,138 B2 1/2005 Pollard
2002/0119045 A1 * 8/2002 Starkweather ..... 416/97 R
2002/0119047 A1 * 8/2002 Starkweather ..... 416/97 R

* cited by examiner

*Primary Examiner*—Andre J. Allen
(74) *Attorney, Agent, or Firm*—John Ryznic

(57) ABSTRACT

A pressure tap probe having a flexible probe tip that is flexible enough to seal a film cooling hole having a roughened surface such as a TBC applied around the hole. The flexible probe tip is flexible enough to deform around the film cooling hole such that an accurate pressure reading can be observed for the film cooling hole. The flexible pressure tap is used to measure the pressure at a plurality of film cooling holes on a turbine airfoil when a pressure and a flow rate of cooling air is passed through the airfoil. A plurality of film cooling holes are measured by using the flexible pressure tap to determine if the cooling passages and film cooling holes are properly sized to provide adequate cooling for the airfoil.

5 Claims, 3 Drawing Sheets

APPARATUS AND METHOD TO MEASURE AIR PRESSURE WITHIN A TURBINE AIRFOIL

CROSS-REFERENCE TO RELATED APPLICATIONS

This application claims the benefit to a U.S. Provisional Patent Application 60/755,598 filed on Dec. 31, 2005 and entitled APPARATUS AND METHOD TO MEASURE AIR PRESSURE WITHIN A TURBINE AIRFOIL.

BACKGROUND OF THE INVENTION

1. Field of the Invention

The present invention relates to airfoils used in gas turbine engines, and more specifically to measuring the pressure drop across cooling holes on the airfoil to determine if the inner cavity for cooling air passage is properly designed.

2. Description of the Related Art Including Information Disclosed Under 37 CFR 1.97 and 1.98

Gas turbine engines use blades and vanes with cooling air passages therein to prevent the airfoils from degrading due to extreme temperatures. These airfoils include film cooling air holes leading from the internal cooling air passages onto the outer surfaces of the airfoils to provide a blanket of cooling air over the airfoil surface, and therefore allowing for highest gas turbine temperatures.

When designing a turbine airfoil, the airflow through the internal cooling passages and the film cooling holes is critical. Too much airflow will result in a waste of cooling air flowing into the gas stream. Too little airflow and the airfoil will lack adequate cooling. It is very important during the design stage to properly size the cooling passages before the blade or vane is put into operation in the gas turbine engine.

The gas turbine industry relies upon processes that measure air pressure within various turbine components (typically blades or vanes). The methods being used to obtain these pressures aren't necessarily standardized. This may be intentional dependent upon the objective, but it has been observed that some manufacturers use methods that do not provide reliable, consistent results. This can lead to problems ranging from one part being rejected up to a situation whereby an engine design is significantly flawed due to erroneous calculations obtained through inadequate methodology or tools. This application addresses the issue.

The method currently used in the prior art involves a pressure measurement device that inserts a small hypodermic tube within one of the turbine components film cooling holes. These holes can vary in size, shape and location. The problem is that the "hypo" tube penetrates internally to varying depths and angles. This method becomes highly subjective to error because of the many dynamic conditions that affect the reading. It would be ideal to get a "static" pressure measurement in these instances. Also, the sealing of the air around the "hypo" tube may be insufficient, thereby contributing to erroneous data as well.

BRIEF SUMMARY OF THE INVENTION

A pressure tap (P-tap) probe and process has been designed by the applicant that minimizes any errors due to these conditions. The applicant's P-tap probe measures pressure at the external location of the cooling holes. This gives us the desired "static" pressure measurement. The probe is also flexible, thereby making access to certain cooling holes easier. Former metal probes make probing at some locations difficult if not impossible.

Sealing between the tip and the part is integral to a reliable pressure measurement. The tip of the probe utilizes a soft material (small "stopper" with a low durometer and chamfered hole) that provides a very reliable seal. Turbine components are often coated with "bond coat" or TBC (thermal barrier coating). These surfaces are generally rough. The tip of the probe is able to seal well on these rough surfaces due to its softness and flexibility.

While measuring pressure with applicant's P-tap pressure probe or any other probe, it's good practice to repeat the measurement once or twice. This is so the operator can observe that the pressure value to be recorded is always going to its highest level. Naturally, the highest value represents what you need to know. Usually the value is displayed on a computer screen or a type of gauge. You want the value to go from untapped to P-tapped fairly quickly, especially since you'll be repeating the process. The flexible P-tap probe lends itself to a quick reaction due to reduced line volume. Narrow (0.0625 inch inside diameter) clear plastic flexible tubing is attached to the probe at the reducing fitting opposite from the tip end. The other end of the tubing attaches to your transducer or gauge. The narrower and shorter the tubing is, the faster the response time becomes.

DETAILED DESCRIPTION OF THE INVENTION

Figure 2:
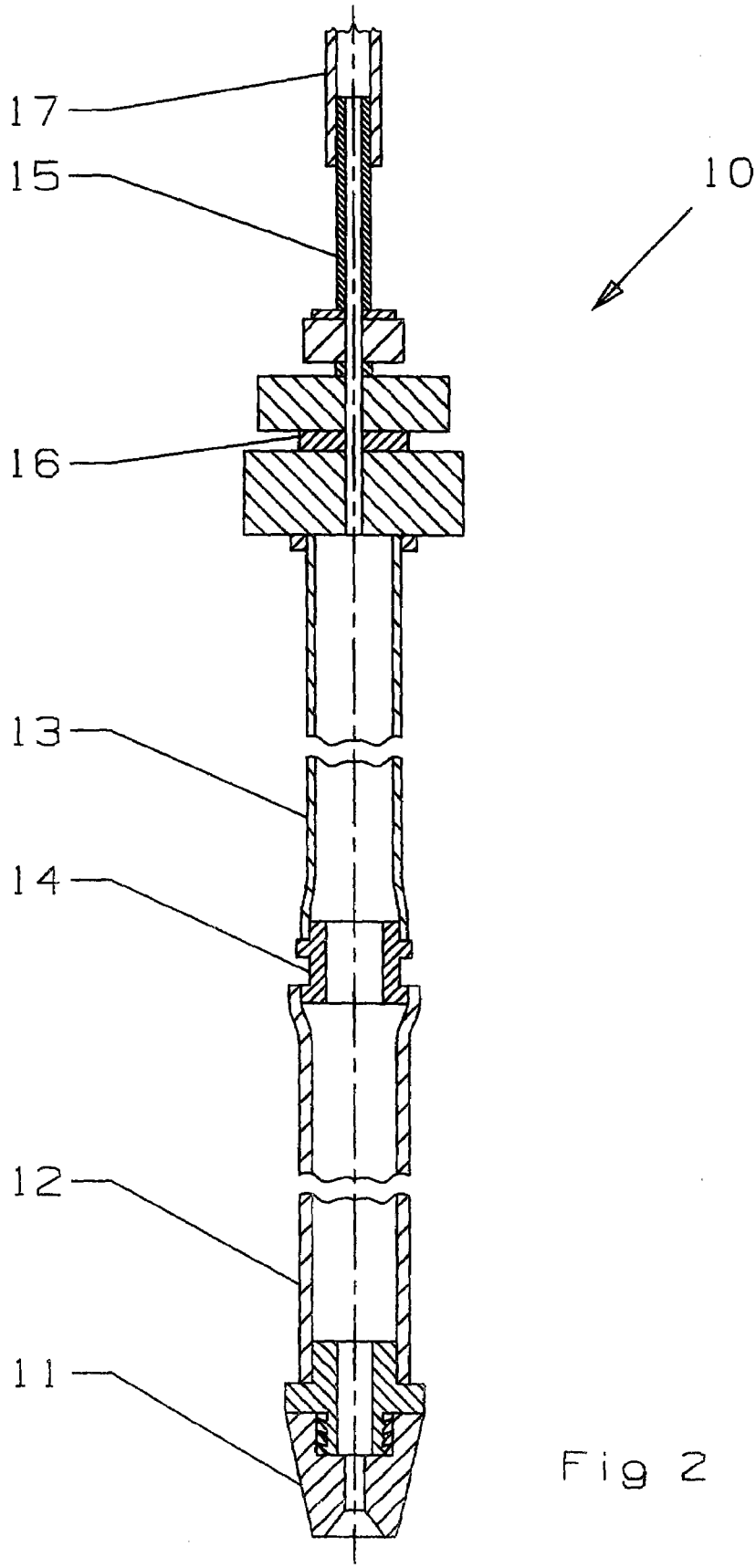
FIG. 2 shows a cross section view of the pressure tap probe of the present invention.

The present invention is a pressure tap probe (P-tap probe) used to measure a pressure at an opening of a film cooling hole in a turbine airfoil such as a blade or a vane. The probe 10 is shown in FIG. 2 and includes a probe tip end 11, a 7/16 inch OD by 5/16 inch ID clear plastic tubing 12 connected to the probe tip end 1, a ¼ inch OD polypropylene tube 13 connected to the 7/16 inch OD clear plastic tubing 12 by a 6 inch riser stake 14 (barbed on both ends), a Scanivalve 0.63 by 1 inch bulged tabulation 15 connected to the yellow ¼ inch OD tube 13 by a Parker Instrument reducing union connection 16, and a 1/16 inch ID Tygon tubing 17 of clear color connected to the Scanivalve bulged tabulation 15 by sliding the Tygon tubing 17 over the end of the Scanivalve bulged tubing 15. The entire probe assembly 10, from the probe tip end 11 to the Scanivalve bulged tabulation 15, is about one foot in length. The 1/16 inch ID Tygon clear plastic tubing 17 is used to connect the probe 10 to an electric processor that detects the pressure through the tube 17 and outputs a result. The probe tip 11 is made of a soft material such that the tip will properly seal the tip over the selected film cooling hole. Since the surface of the airfoil being tested could have a rough thermal barrier coating (TBC) applied around the hole, the tip must be soft enough to deform and form a sealed interface when testing for the static pressure at the hole is performed.

Figure 3:
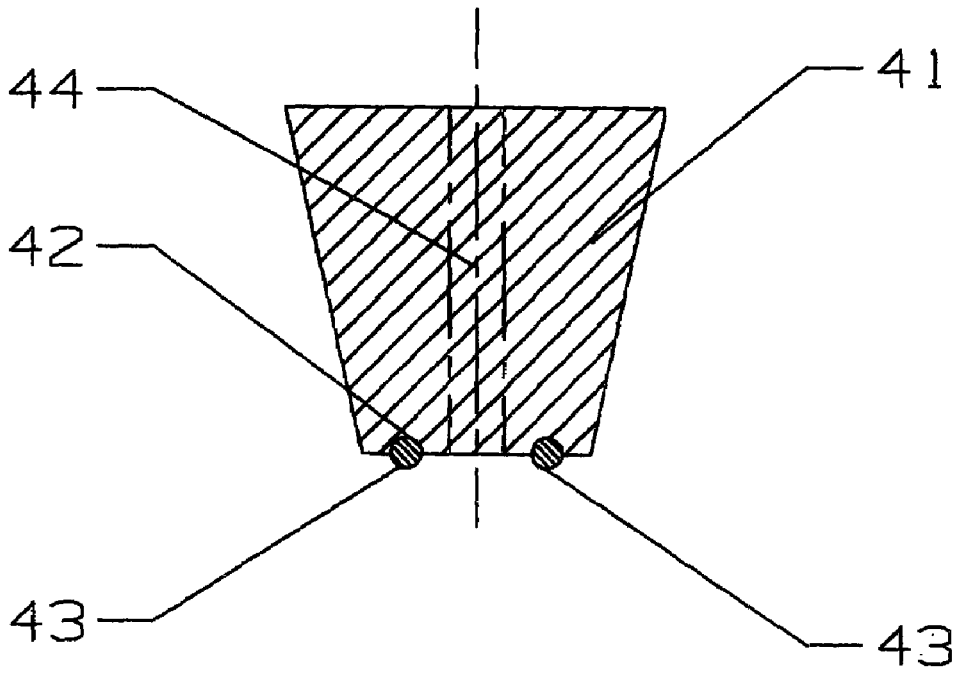
FIG. 3 shows a second embodiment of the flexible tip cap of the present invention.

FIG. 3 shows a second embodiment of the probe tip used in the pressure tap probe of the present invention. In the first embodiment, the probe tip 11 is made of a flexible material that is not resistant to a high temperature. In the second embodiment of FIG. 3, the probe tip 41 is made of a non-flexible material that is resistant to high temperatures and includes a circular groove 42 on the tip end surface in which a flexible O-ring 43 is secured and which forms the flexible seating surface for the probe tip 41. The probe tip 41 body is made of a metal material that can withstand the high temperature in which the probe may be used. The flexible O-ring is formed from a material that is flexible but also is resistant to high temperatures.

Figure 1:
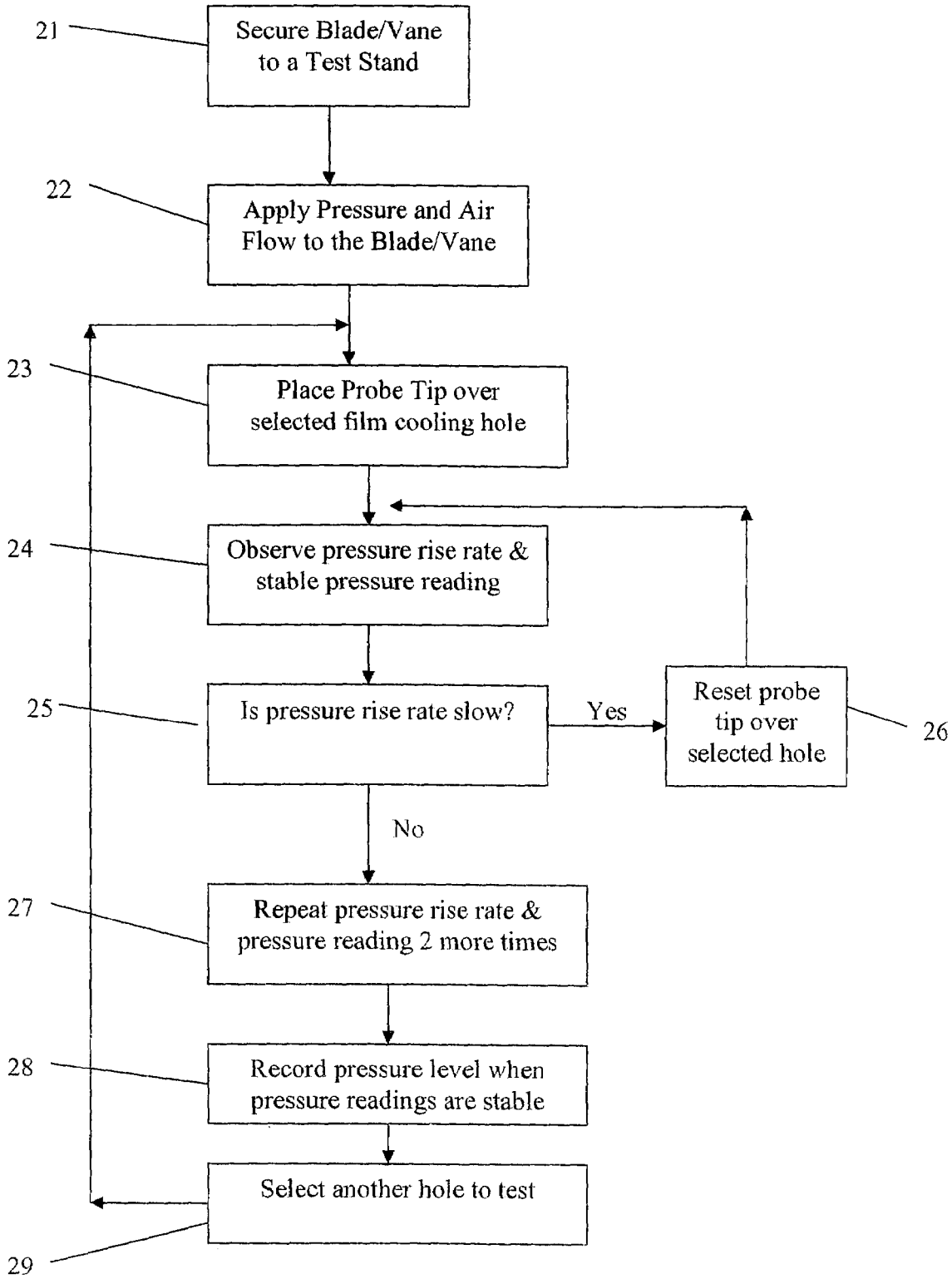
FIG. 1 is a flow chart showing the steps used in the process for measuring the static pressure at various film cooling holes.

FIG. 1 shows the process for testing the blade or vane having the film cooling holes therein. The blade to be tested in mounted on a test stand 21 and the cooling air inlet to the internal cooling air passages is sealed to allow for a pressurized airflow to be delivered to the internal cooling air passages. The pressure and airflow rate need not be at the actual blade operating levels in order for the test to be performed. With the blade sealed, a pressurized airflow is applied 22 through an air opening that is sealed such that airflow through the internal passages and the plurality of film cooling holes occurs. A film cooling hole is selected for testing. The probe tip is placed over the hole 23 such that the hole is sealed by the probe tip. An operator watches a computer monitor 24 when the probe tip is placed over to the film cooling hole to observe the pressure rise rate and the steady-state pressure level at that selected hole. If the pressure rise rate is slow 25, then this is an indication that the probe tip is not adequately sealed over the hole 26. The operator then places the probe tip over the hole again 23 in an attempt to create an adequate seal between the probe tip and the hole. The operator again watches for the pressure rise rate and the stabilized pressure reading to determine if a proper seal has been made 24.

When the operator feels that a proper pressure reading for the selected hole has been observed, the operator then performs another pressure rise rate and pressure level reading for that same hole (step 27) 2 more times in order to observe if the static pressure level is the same for each of the 3 readings. If the 3 readings indicate that a stable pressure level for that specific hole has been observed, the operator will then record the specific hole location and static pressure reading 28 either by hand on paper or by entering the hole number on the computer monitoring the test such that the hole number is assigned the pressure reading obtained from one or all of the 3 tests.

When the testing for the one hole has been performed and recorded, the operator then goes onto the next hole 29 by placing the probe tip over the newly selected hole and performing the same test procedure in order to determine the proper static pressure for that new hole. When an adequate number of holes have been tested for the blade, the test is complete. The size of the blade, the number of cooling passages within the blade, and the number of film cooling holes in the blade will determine how many individual holes will be tested in the process. The objective to testing the static pressure for a number of film cooling holes is to determine if the blade has been designed with the proper size cooling passages and film cooling holes to adequately provide cooling for the blade under the engine operating conditions, including the supply pressure and airflow of cooling air to the blade.

We claim:

1. A process for measuring a pressure in a film cooling hole of a turbine airfoil, the turbine airfoil having an internal cooling air circuit and a plurality of film cooling holes, the process comprising the steps of:

Securing the turbine airfoil to a test stand;

Applying pressure and air flow to the turbine airfoil such that cooling air flows out the film cooling holes;

Placing a probe tip with a flexible tip end over one of the film cooling holes to seal the hole;

Observing a pressure rise rate of the selected hole;

If the pressure rise rate is slow, then re-seal the flexible probe tip over the selected hole until the pressure rise rate is not slow;

Recording the pressure level of the selected hole when the pressure readings for the selected hole is stable; and, Placing the flexible probe tip over another hole to measure the pressure rise rate of the newly selected hole.

2. A pressure tap probe for measuring a pressure level over a film cooling hole of a turbine airfoil, the pressure tap probe comprising:

A flexible probe tip with a pressure hole extending through the tip, the flexible probe tip being flexible enough to seal a film cooling hole having a TBC or other rough surface around the film cooling hole; and, A first flexible tubing connected to the flexible tip to provide a sealed pressure connection.

3. The pressure tap probe of claim 2, and further comprising:

The flexible probe tip being cone shaped with a surface contacting end and a plastic tubing end with a central hole passing from end to end, the surface contacting end having a cone shaped opening on the inner side connected to the central hole such that a thin rim is formed on the surface contacting end to allow for sealing against the contact surface of an airfoil.

4. The pressure tap probe of claim 2, and further comprising:

The flexible probe tip being cone shaped with a surface contacting end and a plastic tubing end with a central hole passing from end to end, the surface contacting end having a circular groove with a flexible O-ring secured in the groove to form a flexible seal against a contacting surface of the airfoil.

5. The pressure tap probe of claim 4, and further comprising:

The flexible probe tip is made from a non-flexible material.

* * * * *